US006029612A

United States Patent [19]

Wietzke et al.

[11] Patent Number: 6,029,612

[45] Date of Patent: Feb. 29, 2000

[54] FLUIDIZED BED REACTOR

[75] Inventors: Donald L. Wietzke; Neil R. Raskin, both of Carlsbad, Calif.; Scott Darling, Annandale, N.J.

[73] Assignee: Foster Wheeler Energia Oy, Helsinki, Finland

[21] Appl. No.: 08/888,790

[22] Filed: Jul. 7, 1997

[51] Int. Cl.[7] ..... B89B 3/00

[52] U.S. Cl. ..... 122/4 D; 110/245

[58] Field of Search ..... 122/4 D; 110/245; 432/15, 58

[56] References Cited

U.S. PATENT DOCUMENTS

| | | | |
|---|---|---|---|
| 4,545,959 | 10/1985 | Schilling et al. | 422/142 |
| 4,817,563 | 4/1989 | Beisswenger et al. | 122/4 D |
| 4,841,884 | 6/1989 | Engstrom et al. | 110/298 |
| 4,864,944 | 9/1989 | Engström et al. | 110/299 |
| 5,370,084 | 12/1994 | Skowyra et al. | 122/4 D |
| 5,678,497 | 10/1997 | Goidich | 110/245 |
| 5,836,257 | 11/1998 | Belin et al. | 110/245 |

FOREIGN PATENT DOCUMENTS

| | | |
|---|---|---|
| 0 179 996 | 5/1986 | European Pat. Off. . |
| 2 681 668 | 3/1993 | France . |
| 195 01 504 | 3/1996 | Germany . |
| 98/25074 | 6/1998 | WIPO . |

*Primary Examiner*—John A. Jeffery
*Assistant Examiner*—Jiping Lu
*Attorney, Agent, or Firm*—Fitzpatrick, Cella, Harper & Scinto

[57] ABSTRACT

A fluidized bed reactor including in its lower part a furnace section having a bed of fluidized solid particles, the furnace section being delimited by side walls such as external side walls and/or partition walls and a bottom grid, and a supplying device for introducing gas into the furnace section at a level above the bottom grid, the supplying device including a gas source chamber, an opening in at least one of the side walls at a level above the bottom grid, and a conduit having a first end connected to the opening and a second end connected to the gas source chamber. The conduit includes a solid flow seal preventing solid particles from flowing backwards from the furnace section into the conduit in a manner preventing or noticeably decreasing introduction of gas from the gas source chamber to the furnace section.

26 Claims, 4 Drawing Sheets

FLUIDIZED BED REACTOR

The present invention refers to a fluidized bed reactor having in its lower part a furnace section, delimited by side walls and a bottom grid, and supplying means, for introducing a gas, such as partial combustion air, into a bed of fluidized particles in the furnace section. Such supplying means include a gas source chamber, such as a windbox and at least one nozzle or conduit connected to one opening in a side wall, for introducing gas from said gas source chamber to the furnace section.

This invention is particularly applicable to large circulating fluidized bed (CFB) boilers having a thermal effect of, e.g., 200–400 MWe, or more, in which boilers the lower section of the boiler furnace and the bottom grid may be divided in two or more furnace sections, e.g., by a dual wall partition structure. The dual wall partition structure may be a complete partition wall reaching in the furnace from one wall to the opposite wall or a partial wall, i.e., the dual wall construction may consist of a continuous or a discontinuous wall between two opposite furnace walls. In these large boilers, partial air may be distributed through supplying means connected to the external side walls and/or to supplying means connected to the partition wall structure. The partition wall structure, which typically is of a dual wall construction may be made of a refractory wall or a cooled wall connected to the cooling water circulation of the boiler.

BACKGROUND OF THE INVENTION

Optimized emission control and maximum fuel burn-up are decisive qualifications for a successful furnace design. Thus, they must especially be taken into consideration in circulating fluidized bed scale-up. A simple proportional scaling up of designs used in smaller systems may easily lead to problems in attempting to provide for a good mixing of fuel, combustion air and fluidized bed solids. Additionally, such designs may suffer from not being capable of providing a uniform furnace temperature within the optimum range and a sufficient heat transfer area. All these problems, which may cause enhanced emissions and less than optimal fuel burn-up, have led to a desire to find alternative solutions. Such solutions have, e.g., included designs with multiple furnaces with a common back pass, providing heat transfer panels and/or partial or full division walls within the furnace, or dividing the lower part of the furnace and the bottom grid with, e.g., a dual wall structure.

Different solutions for sectioning the bottom area of a fluidized bed boiler furnace are known in the prior art. U.S. Pat. No. 4,864,944 discloses a division of a fluidized bed reactor into compartments by partition walls having openings for secondary gas to be distributed in a desired manner into the reactor. The partition walls have ducts which are connected to air supply sources and lead to discharge openings at different heights in the partition walls. Correspondingly, U.S. Pat. No. 4,817,563 discloses a fluidized bed system provided with one or more displacement bodies, which may be provided with lines and inlet openings for introducing secondary gas to segmented sections in the lower reactor.

U.S. Pat. No. 5,370,084 discloses different configurations for effective mixing of fuel in a partitioned circulating fluidized bed boiler, including ducts which feed air into the boiler on the interior walls. U.S. Pat. No. 5,215,042 discloses a CFB reactor divided into compartments by at least one vertical, substantially gas tight partition in the upper part of the combustion chamber. The partition wall comprises cooling tubes and is provided with at least one line with a distributing manifold to feed combustion air into the compartments.

U.S. Pat. No. 4,545,959 discloses a chamber for the treatment of particulate matter in a fluidized bed, comprising a duct with a triangular cross section on the bottom of the chamber, and an arrangement of holes or slots in each of the upwardly sloping side walls of the duct for directing an ancillary gas from the duct into the chamber.

The above-mentioned publications suggest introduction of gas into a reactor chamber, e.g., a furnace chamber, through a partition wall within the chamber. A problem arises, however, as the ducting from the air or gas source chamber to the air or gas injection point may be rather long and cause a high pressure drop. A problem arises also in these conventional supply duct constructions due to solids back sifting, i.e., the problems with solid particles from the furnace tending to flow into the gas supply ducts and an increase in the pressure drop over the gas supply ducts. The increase in pressure drop may be very difficult to attend to or to take into consideration when controlling the gas supply.

Conventional bottom grid nozzle constructions, e.g., those equipped with bubble caps normally reaching upward from the bottom grid, would be exposed to heavy erosion if installed on a vertical partition wall within a fluidized bed, due to very high erosive forces caused by the downward flowing solid particle layers in the vicinity of the wall. In fluidized bed reactor furnaces, solid particles tend to flow upward in the middle of each furnace section and downward along its vertical side walls. Such downward flowing particles come in the lower part of the furnace sections, when the cross-sectional area of the furnace sections abruptly decreases, into intense turbulent motion which may locally lead to very strong erosive forces, e.g., also in the regions of secondary gas inlets. In the prior art no special solution for preventing backsifting into gas nozzles or conduits arranged on partition walls has been disclosed.

It is, therefore, an object of the present invention to provide a fluidized bed reactor with a furnace construction with an improved gas supply configuration.

It is particularly an object of the present invention to provide an improved gas supply configuration suitable for large scale circulating fluidized bed (CFB) boilers.

It is then more specifically an object of the present invention to provide an improved secondary gas supply configuration arranged in a partition wall within the lower part of a boiler furnace.

It is more specifically an object of the present invention to provide a fluidized bed reactor with improved gas supply means, with minimized backsifting of solid particles into gas supply conduits therein.

It is thereby also an object of the present invention to provide a fluidized bed reactor with improved gas supply means with decreased pressure losses in the gas supply means.

SUMMARY OF THE INVENTION

These and other objects of the present invention are achieved in a fluidized bed reactor by arranging in the lower part of a furnace section therein, which furnace section is delimited by side walls and a bottom grid, a supplying means including a gas source chamber, such as a windbox, at least one opening in at least one of said side walls at a level above the bottom grid, and at least one conduit, connected by its one end to said at least one opening and by its other end to said gas source chamber, for introducing gas from said gas source chamber to said furnace section, whereby, said at least one conduit comprises a solid flow seal, preventing solid particles from flowing backward from said furnace section into said at least one conduit in a manner preventing or noticeably decreasing said introduction of gas from said gas source chamber to said furnace section.

In large scale fluidized bed reactors, divided by dual-wall partitions into separate furnace sections, at least a part of the free internal space between the partition walls may according to a preferred embodiment of the present invention constitute the gas source chamber or windbox, providing secondary or other gas to the furnace sections. The gas source chamber may, on the other hand, if desired according to another preferred embodiment of the present invention be formed at another location also, e.g., connected to an external side wall or to the bottom grid.

Secondary gas or other similar gas is typically introduced into furnace sections through a plurality of gas injecting openings formed in the side walls delimiting the furnace sections. The openings may be arranged in a single row at the same vertical level in each wall, or the openings may if desired be arranged in some other configuration and at several different vertical levels in the walls. A conduit, such as a standpipe or a bent pipe construction, is according to the present invention disposed between each of the openings and a gas source chamber, for introducing gas from the gas source chamber through the openings into the furnace sections.

A solid flow seal is formed in the conduits so as to prevent solid particles from flowing backward into the conduit in a manner preventing or noticeably decreasing the introduction of gas from the gas source chamber to the furnace sections. Some minor back and forth flow of solid particles within the conduits close to the openings may be tolerable. The solid flow seals may be formed in different ways, e.g., depending on the location of the gas source chamber.

In a fluidized bed reactor, in which the gas source chamber is formed in the space between two partition walls forming a partition on the bottom grid, secondary gas/air nozzles or conduits in the form of open-ended standpipes may preferably be used. The standpipes have a first open end connected to an opening in one of the partition walls at a first vertical level $l_1$, e.g., at the secondary air injection level, and a second open end opening into the gas source chamber at a second vertical level $l_2$ which is at a higher level than the first vertical level. This construction may be used when at least a portion of the gas source chamber reaches to a vertical level above the injection level of the gas, e.g., the injection level of secondary air.

The standpipe preferably has a circular cross section, but other forms are possible, such as slot like cross sections. The vertical extent of the standpipe, i.e., the difference $l_2-l_1$, has to be big enough to generally prevent solid particles from backsifting therethrough from the furnace section to the gas source chamber.

The standpipe may be bent at its lower end, such that the lower end thereof may be fastened more easily to a vertical or only slightly inclined side wall construction. The standpipe may even have a short nearly horizontal lower portion in order to bring the standpipe out from the side wall construction. Preferably a minimum distance or clearance is provided between the side wall and the standpipe along the entire length of the standpipe, i.e., also when the side wall is inclined and approaches the standpipe at the upper end thereof. Another solution would be to make the standpipe slightly inclined.

The standpipe is, however, preferably substantially upright, but may due to constructional reasons and as discussed above have a lowermost portion, forming $a<90°$, typically about 45°, but always $\geqq 30°$ angle with the horizontal plane. The rest of the standpipe, i.e., the upper portion of the standpipe, is mainly upright forming $a\geqq 30°$ angle with the horizontal plane.

In a fluidized bed reactor having a gas source chamber at a substantially different location, e.g., partly or totally above or below the grid level, another conduit or nozzle construction may be used in order to bring up gas from the gas source chamber to, e.g., the secondary gas level. The conduit, which may be formed of a pipe or other similar element, has according to a preferred embodiment of the present invention the form of an upside down U-bend. A first end of the conduit is connected to an opening at a first vertical level $l_1$ in one of the side walls and a second end of the conduit is connected at a third vertical level $l_3$ to an opening in an enclosure delimiting the gas source chamber. The conduit has between its first and second ends an upward bent portion, having its highest point at a second vertical level $l_2$, which is at a higher level than the first $l_1$ and third $l_3$ vertical levels. The first level, i.e., the secondary air injection level, typically is at a higher level than the third level, which may be, e.g., at the bottom grid level or below or above the grid level.

The vertical extent of an upright standpipe or the height of the first portion of a bent conduit correlates to the solid flow backsifting preventing ability of the conduit. The height difference $\Delta l$ between the first $l_1$, and second $l_2$ vertical levels is directly related to the pressure required to move solid particles through the standpipe, e.g., the larger the $\Delta l$ the longer the standpipe, and the less solid particles are able to backsift through the conduit.

Typically, a vertical column $\Delta l$ of about 1.0 meter may be needed for providing an efficient solid flow seal against Normalfurnace pressure variations.

The constructions described above may be used, as discussed earlier, in fluidized bed reactors having the lower part of the furnace section divided by a dual-wall partition. Such a partition may if desired reach from the bottom grid up to the roof of the furnace, dividing the entire furnace chamber in two separate sections. Such furnace dividing walls preferably include at least one opening in their upper part to allow horizontal mixing of the gases and fluidized particles in the separate furnace sections.

The partition walls dividing the lower part of the furnace or the divisional walls dividing the entire furnace into two parts or sections may preferably be constructed of finned tube panels, where the flow direction of the cooling medium is upwards from a header on the level of or below the furnace bottom. The cooling tubes of a partition wall may extend substantially vertically up to the roof of the furnace, thus forming a divisional wall within the furnace, the tubes providing an additional cooling surface area within the furnace.

In many known fluidized bed reactor constructions, the interior of the dual wall partitions contains various ducts for different purposes, but the interior space formed between the partition walls has not been otherwise utilized. When using, according to the present invention, at least a part of the interior of the dual wall partition as a windbox for air or gas, which is to be distributed into the furnace above the primary air grid, space is correspondingly spared below the main furnace grid. Moreover, the required length of ducting between the windbox and air/gas introduction point in the furnace is minimized, which leads to decreased pressure losses, i.e., lower cost, compared to conventional constructions. The present invention then provides, due to the decreased pressure losses, a better air/gas distribution and hence more optimal reaction conditions within the furnace. Also by locating structures preventing back sifting of solid particles into the interior of a dual wall partition, the structures are protected from the erosive forces of moving solids in the vicinity of the partition.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings in which FIG. 1 schematically shows a vertical cross section of a first exemplary fluidized bed reactor according to the present invention.

DETAILED DESCRIPTION OF THE DRAWINGS

Figure 1:
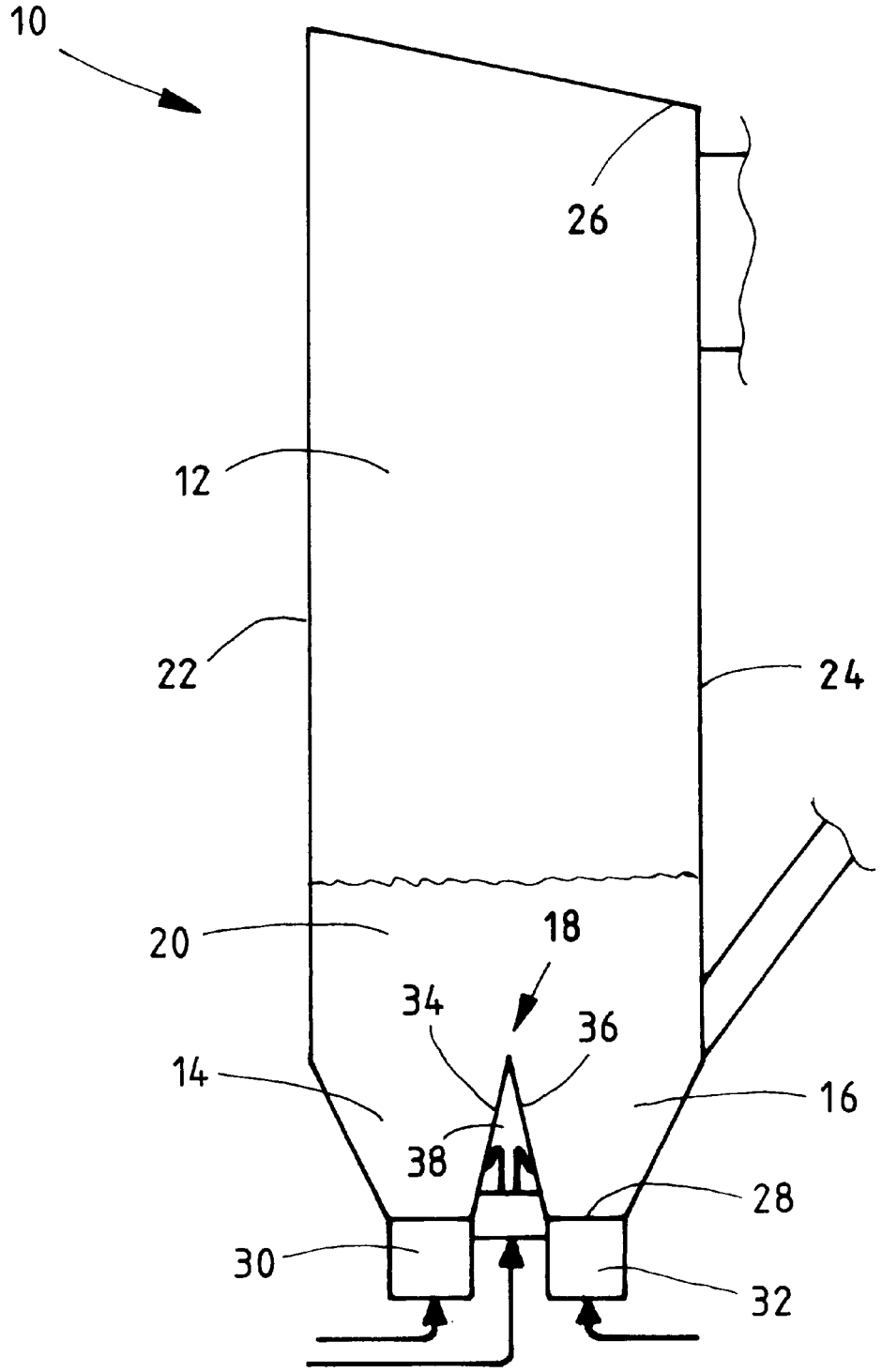
Figure 2:
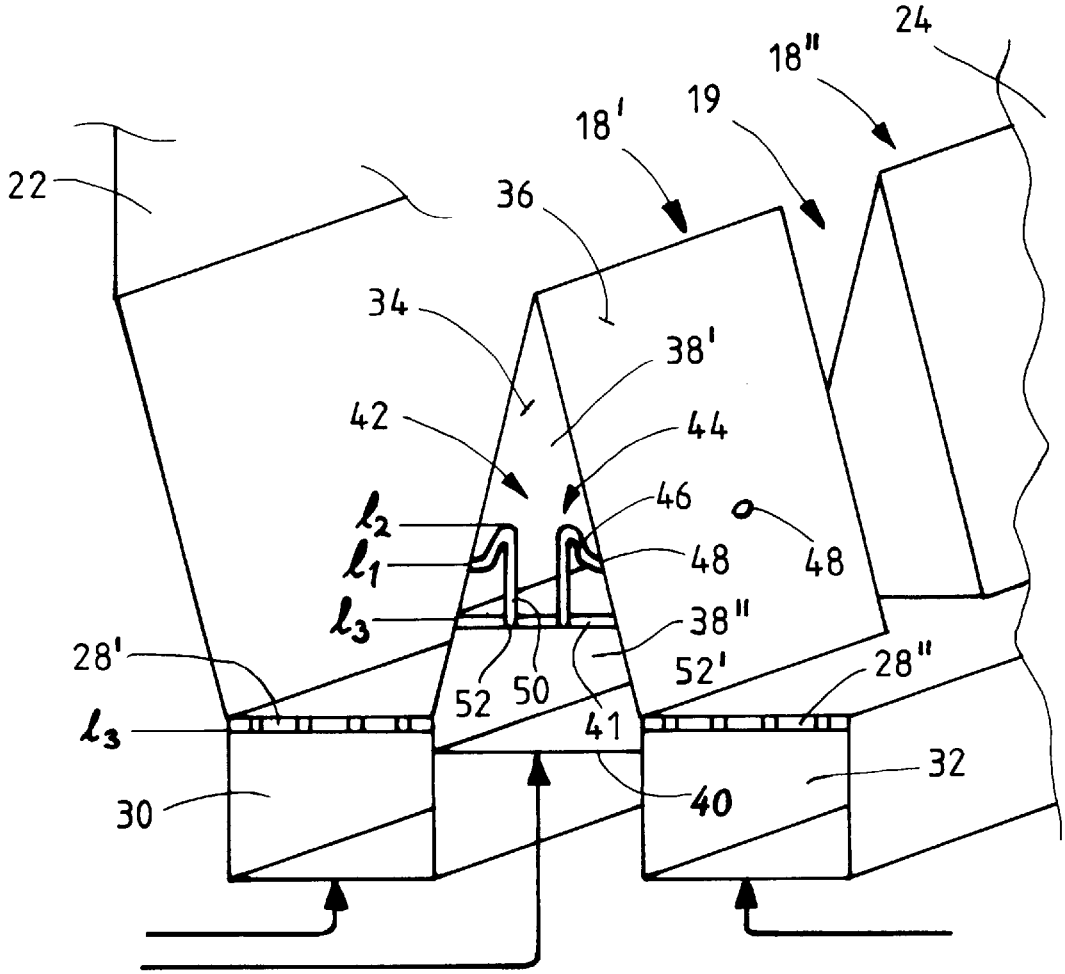
FIG. 2 schematically shows a vertical and partly axonometrical cross section of the lower part of the fluidized bed reactor shown in FIG. 1.

Referring now specifically to FIG. 1 and FIG. 2 of the drawings, the reference numeral 10 refers, in general, to the fluidized bed reactor, having a furnace 12, the lower part of which is divided in two furnace sections 14 and 16 by a partition 18, having a dual wall construction. The partition 18 is in FIG. 2 shown as a discontinuous partition consisting of partial partitions 18' and 18" separated by an intermediate free portion 19 allowing solids and gas flow from one furnace section 14, 16 to the other 16, 14. The discontinuous partition shown in FIG. 2 is one example of a solids and gas flow path between furnace sections 14, 16, other embodiments not shown in these example drawings include one or more conduits through the partition wall; a partial partition dual wall construction; and others. A fluidized bed of solid particles 20 is maintained in the furnace 12. The furnace has external side walls 22 and 24, a roof 26 and a bottom grid 28. Fluidizing air or gas is introduced into the furnace sections 14 and 16 through grid parts 28' and 28" from windboxes 30 and 32.

The partition 18, i.e., the partial partitions 18' and 18", dividing the lower part of the furnace 12, is of a dual wall construction, i.e., formed of two inclined partition walls, i.e., a first 34 and a second 36 partition wall. Thereby, a partition space 38, or an internal space of the partition, is delimited by the partition walls 34 and 36 and a bottom 40 covered by the partition. The bottom 40 is in FIG. 2 shown to be disposed slightly below the grid 28 level, but could be formed at the same level as the grid or even above the grid level. A free space is formed between the windboxes 30 and 32 which can be used for other purposes. The gas space 38 between the partition walls 34 and 36 is divided by a horizontal nozzle supporting partition 41 into an upper 38' and a lower 38" gas space.

Nozzles or conduits 42 and 44 according to the invention are disposed in two rows in the partition space 38' on the nozzle supporting partition or plate 41. The conduits 42 and 44 are made of tubes or pipes formed as upside down U-bends, one leg being longer than the other. The first conduits 42 are connected by their shorter legs 46, i.e., the first ends of the conduits, to openings 48 in the partition wall 34 at a first vertical level $l_1$. The shorter legs 46 reach within the partition space 38' upward from the openings 48 to a second vertical level $l_2$, i.e., the highest point of the U-bend. The first conduits 42 are further connected by their longer legs 50, i.e., the second ends of the conduits, at a third vertical level $l_3$ to openings 52 in the nozzle supporting partition 41, the openings opening into a windbox or gas source chamber formed in the gas space 38" between the bottom 40 and the nozzle support partition 41. Similarly, the other bent conduits 44 are connected to openings, in partition wall 36 and nozzle supporting partition 41.

The height difference $\Delta l = l_2 - l_1$ between the first ends of conduits 42 or 44 and the highest points of the conduits, i.e., of the U-bends, which corresponds to the vertical extension of the shorter legs 46 of the conduits, provides a solid flow seal. The pressure provided by the leg of solids against the counterflowing gas stream within the conduit then prevents particles from flowing from the furnace sections 14 and 16 upward into the conduits in such a manner that a severe pressure drop affecting gas flow through the conduits would arise. The solid flow seal also prevents backsifting of solid particles through the entire conduits 42, 44 from the furnace to the windbox 38".

Thereby, in the FIGS. 1 and 2 embodiment openings 48, conduits 42, 44, including first legs 46 and second legs 50, as well as, a windbox 38" constitute e.g., a secondary gas supplying means for the fluidized bed reactor.

Figure 3:
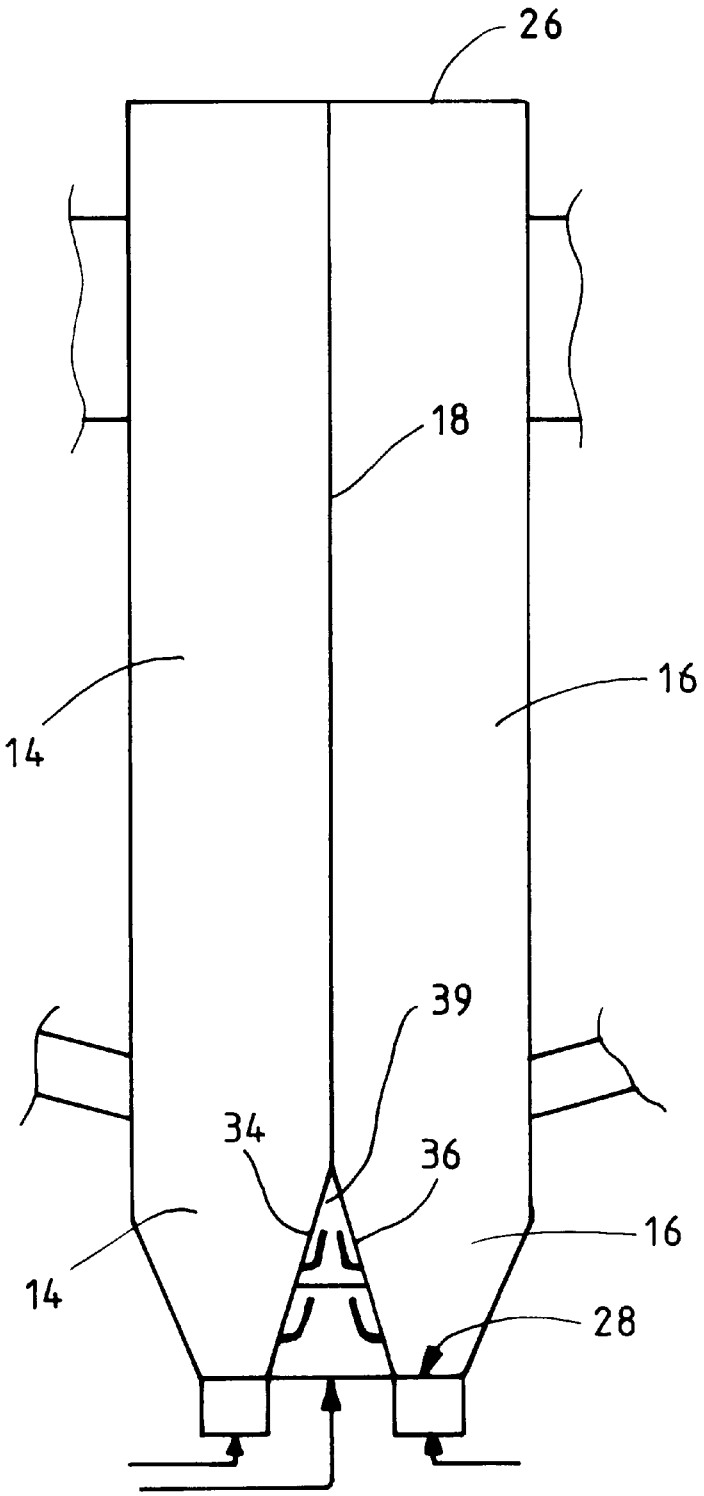
FIG. 3 schematically shows a vertical cross section of a second fluidized bed reactor according to the present invention.
Figure 5:
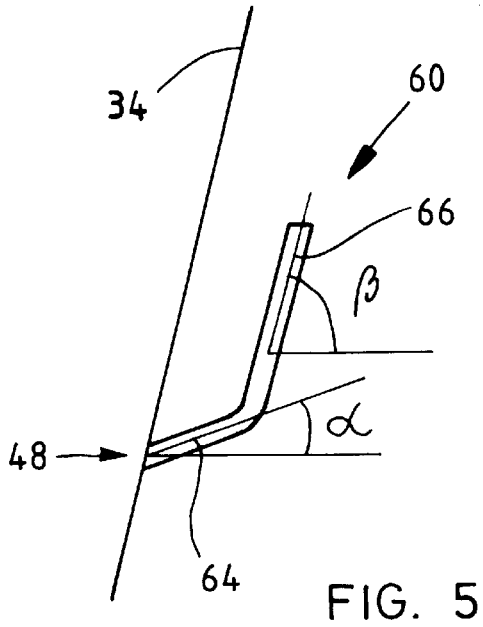
Figure 4:
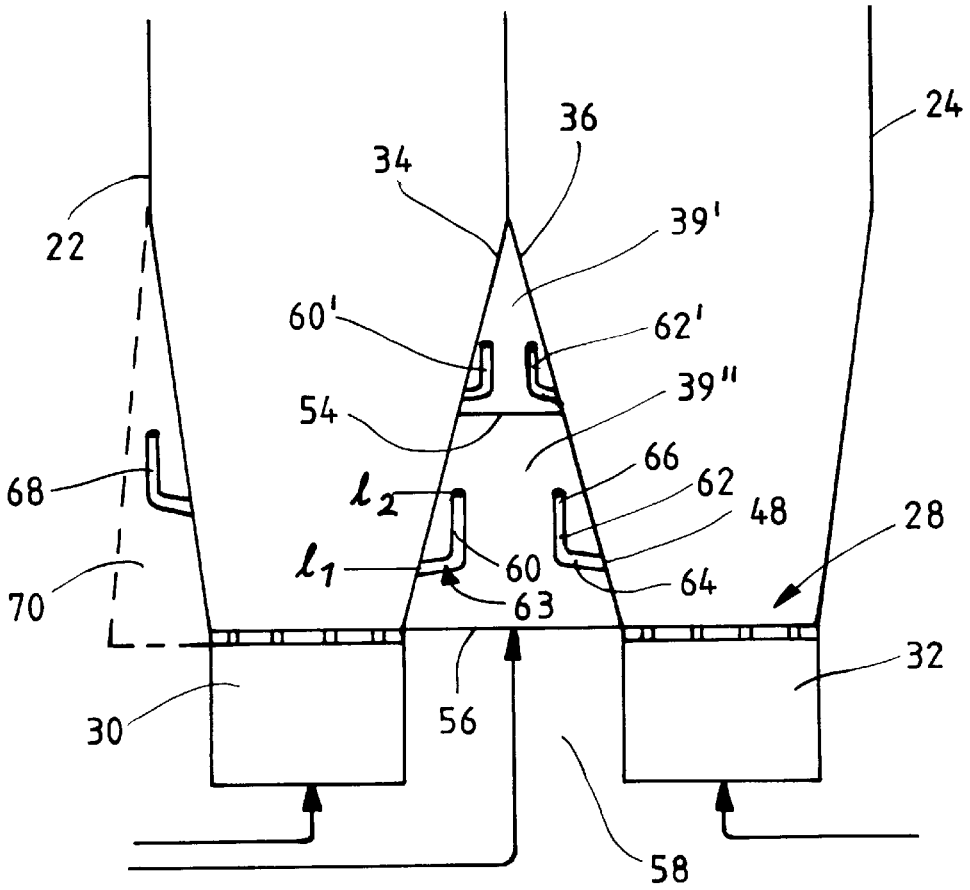
FIG. 4 schematically shows a vertical cross section of the lower part of the second fluidized bed reactor shown in FIG. 3, and FIG. 5 schematically shows an enlargement of a cross section of a standpipe connected to a side wall according to the present invention.

FIGS. 3, 4 and 5 show another preferred embodiment of the present invention. The same reference numerals as those in FIGS. 1 and 2 have been used where applicable. In this embodiment a partition 18 reaches from the bottom grid 28 to the roof 26 dividing the entire furnace into two sections 14 and 16. A discontinuous partition, as indicated by reference numeral 19 in FIG. 2, or other similar solids and gas communication conduit between the furnace sections 14 and 16 may also be provided. The lowermost portion of the partition 18 comprises two partition walls 34, 36, forming a pyramidal free space 39 between the partition walls. The space 39 between partition walls 34 and 36 and a bottom plate 56 is used as a windbox or gas source chamber for the gas supplying means. The gas source chamber may be divided by a horizontal partition 54, as shown in FIG. 4, into an upper 39' and a lower 39" windbox.

The bottom plate 56 is disposed at the bottom grid level 28, but could be disposed above or below said level. A free space 58 is due to this construction formed below the grid level between the fluidizing air windboxes 30, 32, which space may be used for locating ancillary elements which otherwise would have to be located on the periphery of the reactor. The reactor's total footprint area may thus be used more efficiently.

In this embodiment the gas injecting conduits 60, 62 are simple upright open ended standpipes located within the lower partition space 39", the space thus forming a windbox.

The standpipes are connected by their lower ends 64 at a vertical level $l_1$ to openings 48 in the partition walls 34, 36. The upper free ends 66 of the conduits reach upward within the partition space 39 to a vertical level $l_2$. The difference $\Delta l$ in height between levels $l_1$ and $l_2$ provides the solid flow seal preventing solid flow upward in the conduits 60, 62 and into the partition space 39".

Air is supplied from the free gas space or windbox 39" through conduits 60, 62, e.g., as secondary air into the furnace sections 14 and 16. The air flows from the windbox 39" into the standpipes 60 and 62 at their upper open ends 66 and further downward through the standpipes, via a bend 63 at the lower end of the standpipes and through openings 48 into the furnace. The lower end of the standpipes is bent for better enabling a fixing of the standpipes to the openings 48 in the generally vertical walls 34, 36.

FIG. 5 shows more clearly an exemplary position of a standpipe 60, connected to opening 48 in partition wall 34. The lower end 64 of the standpipe is disposed almost horizontally, upwardly inclined in an angle $\geqq 30°$ but $<90°$ to the horizontal plane, in order for the standpipe to be able to stand out from the wall. The upper or main part 66 of the standpipe is almost vertical, inclined in an angle $\beta > 45°$ to the horizontal plane.

Typically all secondary air or gas conduits are arranged to introduce air or gas at a certain predetermined level. There may, however, be conduits at different levels, as well. Thus, conduits 60' and 62' (in FIG. 4) may be used to introduce tertiary air at a higher level than conduits 60 and 62. The tertiary air conduits 60' and 62' are as shown in FIG. 4 located in the separate upper portion 39' of the free gas space 39. The horizontal partition 54 dividing the free gas space into separate lower and upper gas spaces enables separate control of, e.g., secondary and tertiary air injection. Vertical partition walls may also be used (not shown in the drawings) to divide the free gas space further and to enable separate control of gas injected to the separate furnace sections 14 and 16.

There may also be conduits connected to openings in the external side walls 22 and 24. Such a conduit 68 is depicted in FIG. 4. The conduit is located in a windbox 70 connected to the external side wall 22.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

Therefore, even if the present invention has mainly been described in connection with large fluidized bed boilers having a partition dividing the furnace into two or more sections, the conduit constructions according to the present invention may, however, be applied in non-divided furnace reactors as well. Then the upright conduits are connected to external walls and gas source chambers in connection therewith.

Also, the present new conduit construction may, of course, be used to feed other suitable fluid, such as some ancillary fluid or air and fuel mixtures, into a furnace.

What is claimed is:

1. A fluidized bed reactor comprising:

at least one furnace section delimited by side walls and a bottom grid, said at least one furnace section provided for containing a bed of fluidized solid particles therein; and supplying means for introducing a gas into said at least one furnace section at a level above said bottom grid, said supplying means comprising (i) a gas source chamber delimited by partition walls extending upwards from said bottom grid, and a bottom, (ii) at least one opening in at least one of said partition walls at a level above said bottom grid, and (iii) at least one conduit, having a first end connected to said at least one opening at a first vertical level $l_1$ and a second end connected to said gas source chamber, for introducing gas from said gas source chamber into said at least one furnace section, said at least one conduit comprising a solid flow preventing element for preventing solid particles from flowing backward from said at least one furnace section into said at least one conduit.

2. A fluidized bed reactor according to claim 1, wherein said gas source chamber comprises a windbox.

3. A fluidized bed reactor according to claim 1, wherein the gas is partial combustion air.

4. A fluidized bed reactor according to claim 1, wherein said partition walls extend upwardly from said bottom grid at an acute angle.

5. A fluidized bed reactor according to claim 1, wherein said solid flow preventing element is formed by said at least one conduit having a highest point at a second vertical level $l_2$, which second vertical level $l_2$ is higher than the first vertical level $l_1$.

6. A fluidized bed reactor according to claim 5, wherein the second end of said at least one conduit is connected at a third vertical level $l_3$ to an opening in an enclosure delimiting said gas source chamber, said conduit having the highest point at an upward bent portion thereof at the second vertical level $l_2$, between its first end and second end.

7. A fluidized bed reactor according to claim 6, wherein said gas source chamber is at least partly above said bottom grid and the first vertical level is above the third vertical level.

8. A fluidized bed reactor according to claim 1, wherein said supplying means comprises a plurality of openings at the same vertical level in at least one of said partition walls, and corresponding conduits being connected to each of said openings.

9. A fluidized bed reactor according to claim 1, wherein said solid flow preventing element is formed by said at least one conduit comprising the second end being within a gas source chamber at a second vertical level $l_2$, which is higher than the first vertical level $l_1$.

10. A fluidized bed reactor according to claim 9, wherein said at least one conduit is a mainly upright standpipe having a bent lower portion connecting said standpipe to a respective opening in said partition wall.

11. A fluidized bed reactor according to claim 1, wherein said conduit is a standpipe having (i) a lower upward inclined portion, an axis thereof forming an angle greater than or equal to 30° but less than 90° with a horizontal plane, and (ii) an upper portion, an axis thereof forming an angle greater than 45° with the horizontal plane.

12. A fluidized bed reactor according to claim 1, wherein said solid flow preventing element is formed by said at least one conduit having:

(i) a first substantially upright conduit portion connected by its lower end to a respective one of said at least one openings at the first vertical level in one of said partition walls, (ii) a second substantially upright conduit portion connected by its lower end to an air distributor plate connected to said gas source chamber at a third vertical level, and (iii) the upper ends of said first and second conduit portions being connected to each other at a second vertical level, which is higher than the first vertical level.

13. A fluidized bed reactor according to claim 12, wherein the third vertical level $l_3$ is lower than the first vertical level $l_1$.

14. A fluidized bed reactor according to claim 1, wherein said fluidized bed reactor comprises two furnace sections which are separated from each other by a partition and said supplying means for introducing gas into said furnace sections are connected to the partition.

15. A fluidized bed reactor according to claim 1, wherein:

(i) said fluidized bed reactor comprises two furnace sections separated by said partition walls, which have a double wall construction, being formed of two substantially upright or inclined partition walls delimiting a partition space between them, and (ii) said supplying means for introducing gas into said furnace sections are connected to said partition walls and include openings in said partition walls and conduits arranged within the partition space and connected by their first ends to said openings in said partition walls and by their second ends in flow communication with said gas source chamber.

16. A fluidized bed reactor according to claim 15, wherein a portion of the partition space between said two partition walls forms said gas source chamber, and said conduits are standpipes arranged within said gas source chamber.

17. A fluidized bed reactor according to claim 15, wherein the partition space is delimited at its vertical sides by the two partition walls and at its bottom by a nozzle supporting plate separating the partition space from said gas source chamber, and said conduits arranged within the partition space are connected by their second ends to openings in the nozzle supporting plate, for providing gas from said gas source chamber to said furnace sections.

18. A fluidized bed reactor according to claim 15, wherein the partition space is formed by cooling surfaces.

19. A circulating fluidized bed boiler comprising:

a combustion chamber delimited by side walls, a bottom grid and a roof, the side walls being made of cooling surfaces, forming a portion of a water/steam system of said boiler, said combustion chamber provided for containing a bed of fluidized solid particles therein;

at least one division wall, reaching mainly from the bottom grid to the roof, for forming at least two separate combustion chamber sections in said combustion chamber, said at least one division wall being made of cooling surfaces connected to the water/steam system of said boiler, a lowermost portion of said at least one division wall being formed as a dual wall partition section, said dual wall partition section extending upwards from the bottom grid and having solids/gas flow paths between the separate combustion chamber sections, and a free gas space forming a windbox defined by the walls in said dual wall section and a bottom; and secondary air conduits provided in the gas space between the walls of said dual wall partition section, inlet ends of said conduits being connected to the windbox and outlet ends of said conduits being connected to openings in the walls of said dual wall partition section, for introducing air from the windbox into the combustion chamber sections, the secondary air conduits comprising a solid flow preventing element, preventing solid particles from flowing backward from said combustion section into said conduits.

20. A fluidized bed boiler according to claim 19, wherein:

(i) the conduits are disposed in said windbox, and (ii) the conduits are mainly upright standpipes connected by their lower ends, which are the outlet ends of the air conduits, at a first vertical level $l_1$ to openings in the walls of said dual wall partition section, and by their upper ends to the windbox, the upper ends being the inlet ends of the air conduits and located at a second vertical level $l_2$ higher than the first vertical level.

21. A fluidized bed boiler according to claim 20, wherein a height difference $\Delta h$ between the first vertical level $l_1$ and the second $l_2$ vertical level is about 1.0 m to provide a seal leg by the pressure difference between the windbox and the combustion section.

22. A fluidized bed boiler according to claim 19, wherein:

(i) the free gas space is divided by a horizontal partition into an upper free gas space and a lower free gas space;

(ii) the secondary air conduits in said lower free gas space are connected to a row of openings at a first level in the walls of said dual wall partition section, and (iii) tertiary conduits are provided in said upper free gas space and connected to a row of openings at a second level in said dual wall partition section.

23. A fluidized bed boiler according to claim 19, wherein the free gas space is divided by a vertical partition.

24. A fluidized bed boiler according to claim 19, wherein the cooling surfaces of said side walls are one of finned tube panels and membrane walls.

25. A fluidized bed boiler according to claim 19, wherein the dual wall partition section is continuous.

26. A fluidized bed boiler according to claim 19, wherein the dual wall partition section is discontinuous.

* * * * *